US010779689B2

(12) United States Patent
Howard et al.

(10) Patent No.: US 10,779,689 B2
(45) Date of Patent: Sep. 22, 2020

(54) SHOWER ATTACHMENT TO KEEP STEAM WITHIN A BATHROOM SHOWER

(71) Applicants: Ryan Howard, Twinsburg, OH (US); Melissa Howard, Twinsburg, OH (US); John Hradisky, Aurora, OH (US)

(72) Inventors: Ryan Howard, Twinsburg, OH (US); Melissa Howard, Twinsburg, OH (US); John Hradisky, Aurora, OH (US)

( * ) Notice: Subject to any disclaimer, the term of this patent is extended or adjusted under 35 U.S.C. 154(b) by 0 days.

(21) Appl. No.: 16/272,743

(22) Filed: Feb. 11, 2019

(65) Prior Publication Data

US 2019/0246846 A1 Aug. 15, 2019

Related U.S. Application Data

(60) Provisional application No. 62/630,075, filed on Feb. 13, 2018.

(51) Int. Cl.

| | |
|---|---|
| ***A47K 3/30*** | (2006.01) |
| ***A61H 33/06*** | (2006.01) |
| ***A47K 3/28*** | (2006.01) |

(52) U.S. Cl.

CPC ..... *A47K 3/30* (2013.01); *A61H 33/066* (2013.01); *A47K 3/281* (2013.01); *A47K 2003/307* (2013.01); *A61H 2033/068* (2013.01)

(58) Field of Classification Search

CPC ..... A47K 3/30; A61H 33/066
USPC ..... 4/527, 596–596
See application file for complete search history.

(56) References Cited

U.S. PATENT DOCUMENTS

| | | | | |
|---|---|---|---|---|
| 5,070,550 | A * | 12/1991 | Reeves | A47K 3/30 4/558 |
| 5,384,921 | A * | 1/1995 | Zieg | A47K 3/281 4/534 |
| 2015/0342827 | A1* | 12/2015 | Kim | A61H 33/066 4/524 |

* cited by examiner

*Primary Examiner* — Christine J Skubinna

(57) ABSTRACT

A shower attachment to keep steam within a bathroom shower includes a plurality of telescopic rods, a first dome panel, a second dome panel, at least one inner fastener, and at least one outer fastener. The plurality of telescopic rods is mounted opposite of each other and functions as a framing structure. The first dome panel and the second dome panel are slidably positioned offset of each other to fit within opposing walls of a bathroom shower. The first dome panel and the second dome panel are terminally mounted to each other by the at least one inner fastener and the at least one outer fastener so that the first dome panel and the second dome panel can position atop the plurality of telescopic rods. Resultantly, the first dome panel and the second dome panel are able to trap the steam vapor within a bathroom shower.

12 Claims, 10 Drawing Sheets

SHOWER ATTACHMENT TO KEEP STEAM WITHIN A BATHROOM SHOWER

The current application claims a priority to the U.S. Provisional Patent application Ser. No. 62/630,075 filed on Feb. 13, 2018.

FIELD OF THE INVENTION

The present invention relates generally to a shower attachment. More specifically, the present invention is a lightweight top or dome that can be easily installed over a bathroom shower.

BACKGROUND OF THE INVENTION

A bathroom shower is a place in which a person baths under a spray of typically warm or hot water. A bathroom shower can be installed as a small shower stall or bathtub with a plastic shower curtain or door. However, an internal temperature of a showering session is difficult to maintain due to the fact warm air exits from the top of a bathroom shower. A steam shower is a type of bathing, where a humidifying steam generator produces water vapor that is dispersed around a person's body. In other words, a steam shower is essentially a steam room that offers the typical features of a bathroom shower. A steam showers is generally found in self-contained enclosure to prevent water vapors from escaping into the rest of the room. Even though a steam shower is able to maintain an internal temperature of a showing session, a steam shower can be expensive to install and does not functions as a retrofitting unit for existing bathroom showers.

It is an object of the present invention to provide a solution for this issue by providing users with lightweight top or dome that can easily install over a bathroom showers. More specifically, the present invention is able to provide a dome like structure that can be easily installed within a bathroom shower. Additionally, the present invention functions as a telescopic assembly so that the present invention can easily fit any size bathroom showers. Furthermore, a lighting unit can also be integrated into the present invention to provide additional lighting features. As a result, the present invention is able to provide an inexpensive and easy solution for converting a bathroom shower to a steam shower.

DETAIL DESCRIPTIONS OF THE INVENTION

All illustrations of the drawings are for the purpose of describing selected versions of the present invention and are not intended to limit the scope of the present invention.

The present invention is a lightweight dome that easily fits over a bathroom shower so that the bathroom shower can be converted into an enclosure. More specifically, when the present invention is installed within the bathroom shower, air flow is contained within the bathroom shower thus trapping steam vapor during a showering process. As a result, the internal shower temperature increases throughout the showering process, giving off the feel of "a steam like experience".

Figure 1:
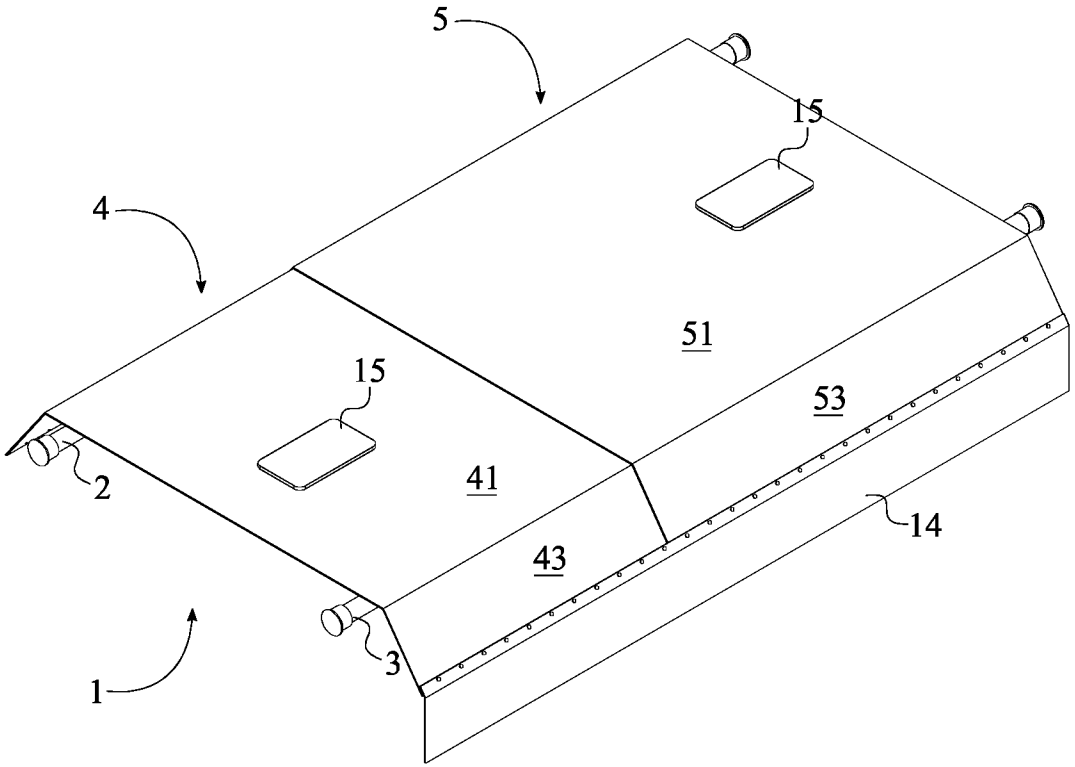
FIG. 1 is a top perspective view of the present invention.
Figure 2:
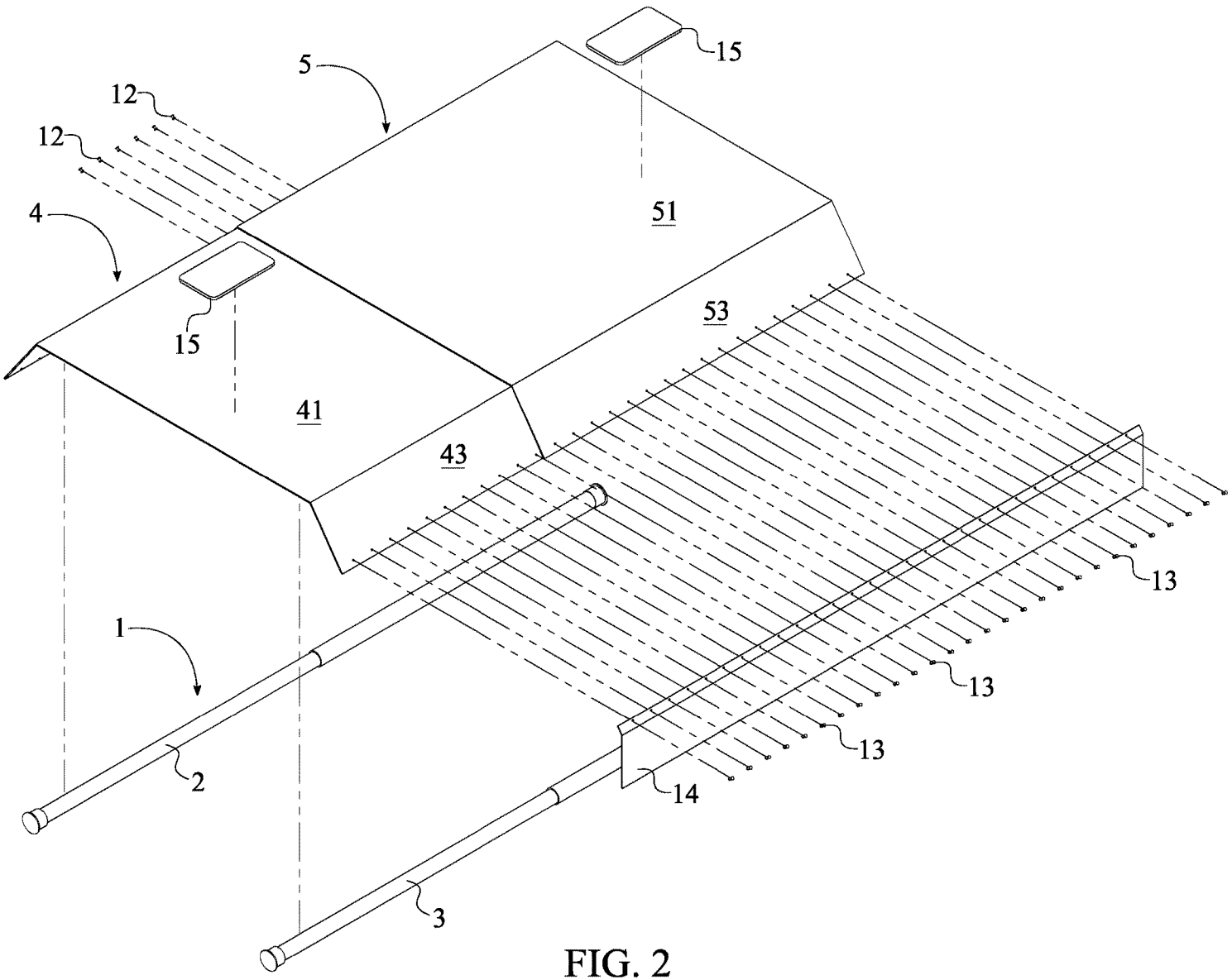
FIG. 2 is a top exploded perspective view of the present invention.
Figure 3:
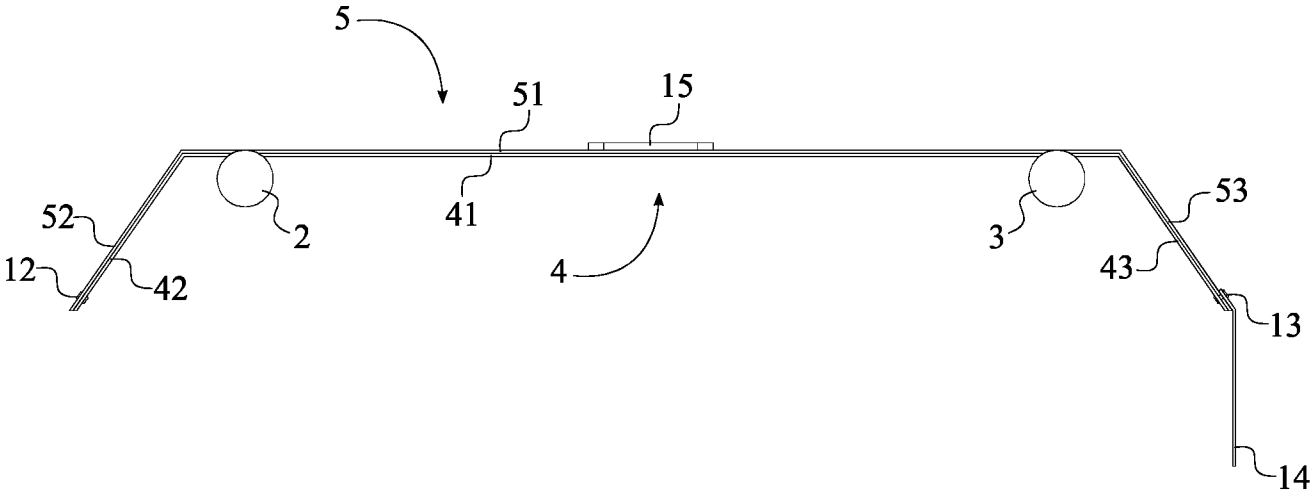
FIG. 3 is a side view of the present invention.

The present invention comprises a plurality of telescopic rods 1, a first dome panel 4, a second dome panel 5, at least one inner fastener 12, and at least one outer fastener 13 as shown in FIG. 1-3. In reference to the general configuration of the present invention, the plurality of telescopic rods 1 is mounted opposite of each other within two opposing walls of the bathroom shower. The plurality of telescopic rods 1 functions as the structural members for the present invention as the rest of the components are either positioned or connected along the plurality of telescopic rods 1. The first dome panel 4 and the second dome panel 5 are slidably positioned offset of each other so that the first dome panel 4 and the second dome panel 5 can adjust according to the distance between the two opposing walls. The first dome panel 4 and the second dome panel 5 are terminally mounted to each other by the at least one inner fastener 12 and the at least one outer fastener 13 thus securing the first dome panel 4 and the second dome panel 5 to each other. In other words, the at least one inner fastener 12 mounts the first dome panel 4 and the second dome panel 5 with respect to a one edge. The at least one outer fastener 13 mounts the first dome panel 4 and the second dome panel 5 with respect to an opposite edge. The first dome panel 4 and the second dome panel 5 are positioned atop the plurality of telescopic rods 1 so that the steam vapor can be trapped within the bathroom shower. As a result, the present invention is able to increase the internal temperature throughout the showering process.

Due to the similar shape and the offset positioning of both the first dome panel 4 and the second dome panel 5, the first dome panel 4 and the second dome panel 5 can easily slide along each other to accommodate different distances of the two opposing walls. The first dome panel 4 and the second dome panel 5 are preferably made of lightweight and transparent plastic or any other type of lightweight and transparent material in order to reduce the amount of weight acting upon the plurality of telescopic rods 1 and to allow light transmission.

The first dome panel 4, which partially converts the existing bathroom shower into the enclosure, comprises a first flat section 41, a first inner section 42, and a first outer section 43. In reference to FIG. 4, the first inner section 42 and the first outer section 43 are oppositely positioned of each other about the first flat section 41 thus delineating a shape similar to an isosceles trapezoidal body without the base leg. More specifically, the first inner section 42 is angularly connected along the first flat section 41. The first outer section 43 is angularly connected along the first flat section 41 and positioned opposite of the first inner section 42. Resultantly, the first inner section 42 and the first outer section 43 are oriented towards the plurality of telescopic rods 1 and away from each other thus delineating the shape of the isosceles trapezoidal body without the base leg.

The second dome panel 5, which partially converts the existing bathroom shower into the enclosure, comprises a second flat section 51, a second inner section 52, and a second outer section 53. In reference to FIG. 5, the second inner section 52 and the second outer section 53 are oppositely positioned of each other about the second flat section 51 thus delineating a shape similar to an isosceles trapezoidal body without the base leg. More specifically, the second inner section 52 is angularly connected along the second flat section 51. The second outer section 53 is angularly connected along the second flat section 51 and positioned opposite of the second inner section 52. Resultantly, the second inner section 52 and the second outer section 53 are oriented towards the plurality of telescopic rods 1 and away from each other thus delineating the shape of the isosceles trapezoidal body without the base leg.

Figure 4:
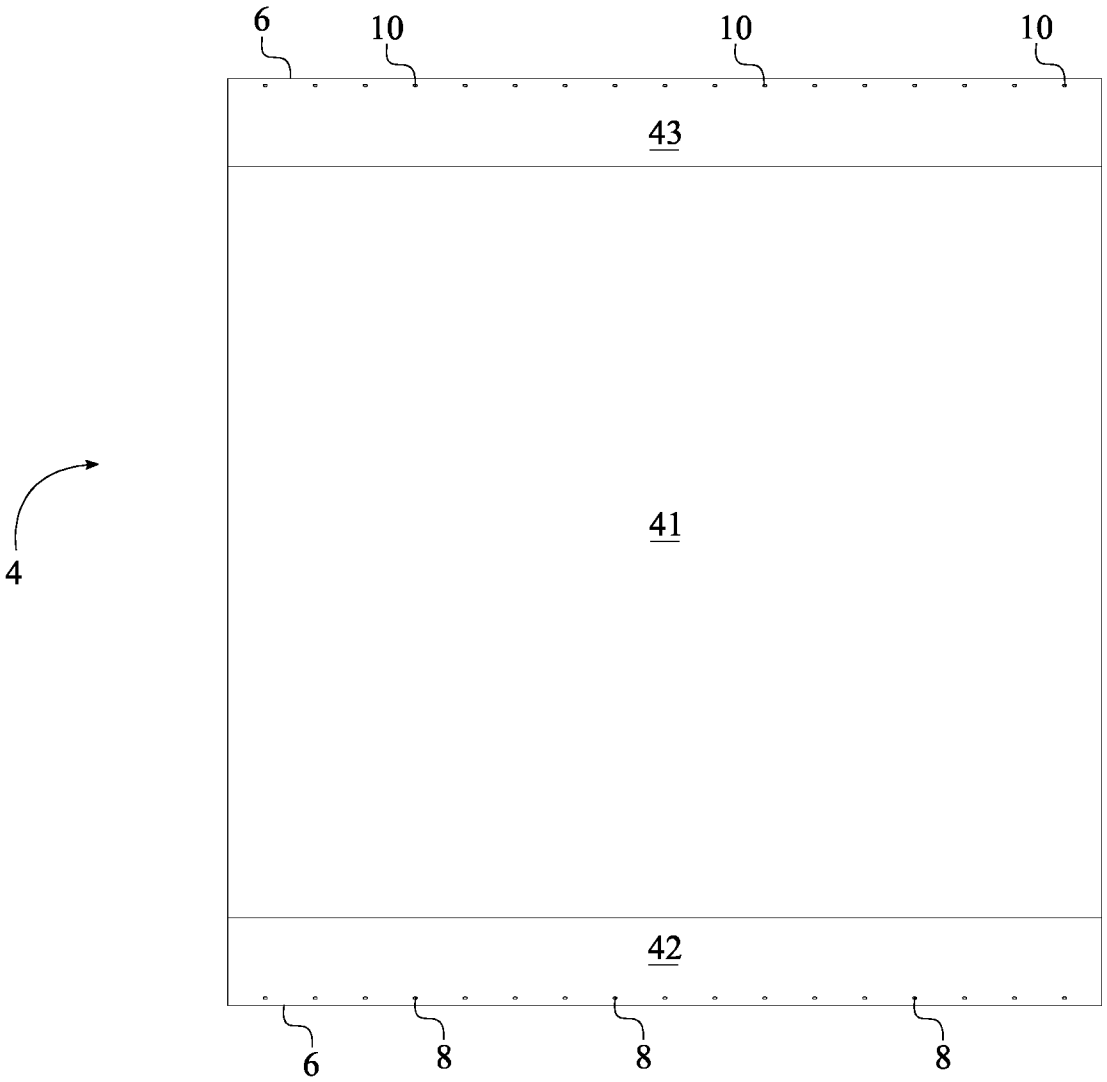
FIG. 4 is a top view of the first dome panel of the present invention.
Figure 5:
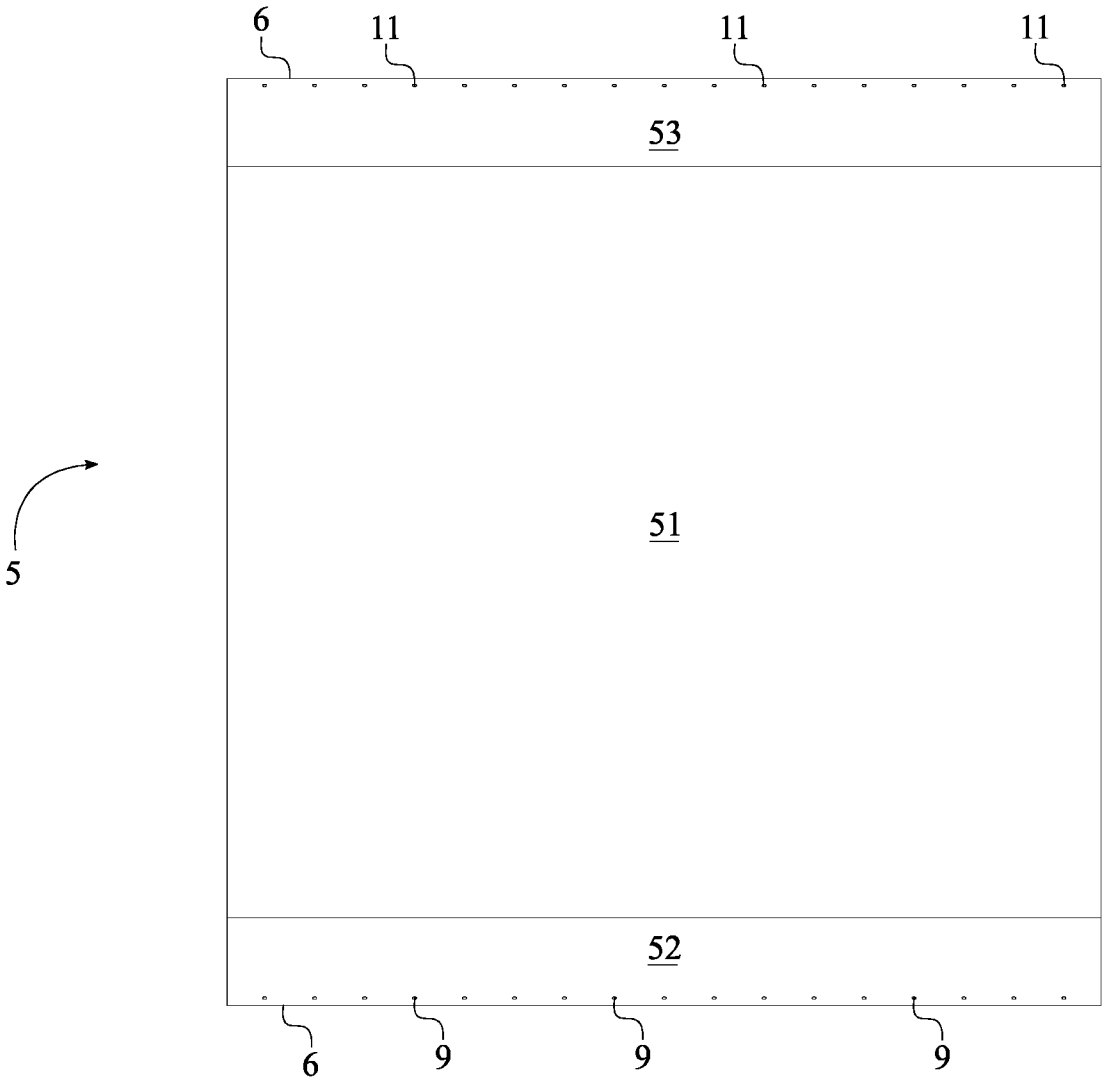
FIG. 5 is a top view of the second dome panel of the present invention.
Figure 6:
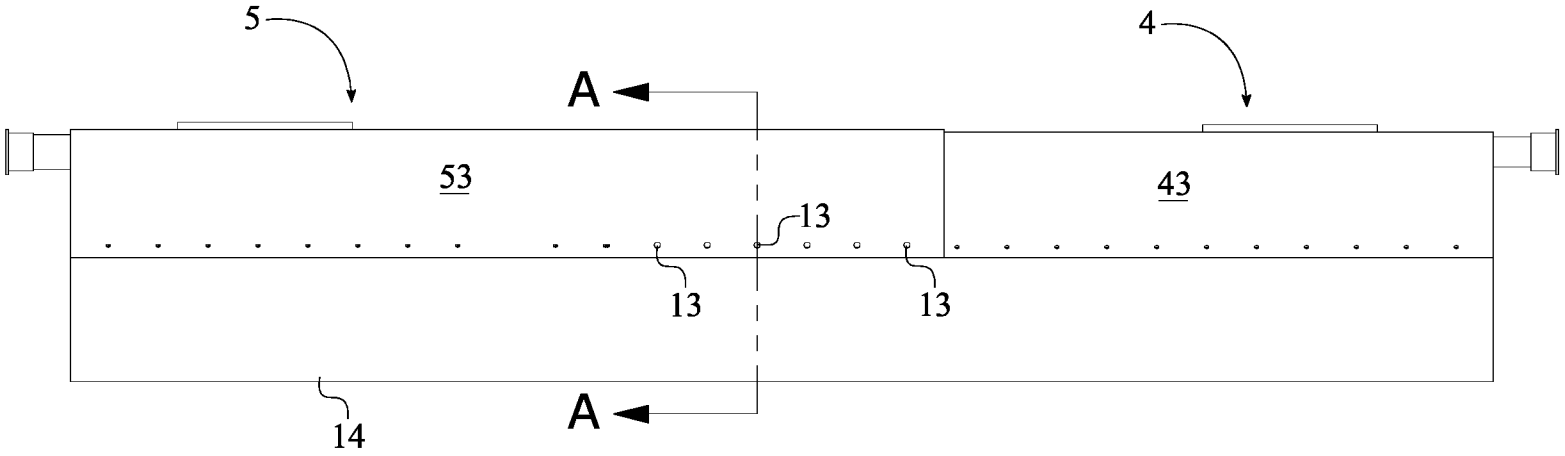
FIG. 6 is a side view of the present invention, showing the plane upon which a cross sectional view is taken shown in FIG. 7.
Figure 7:
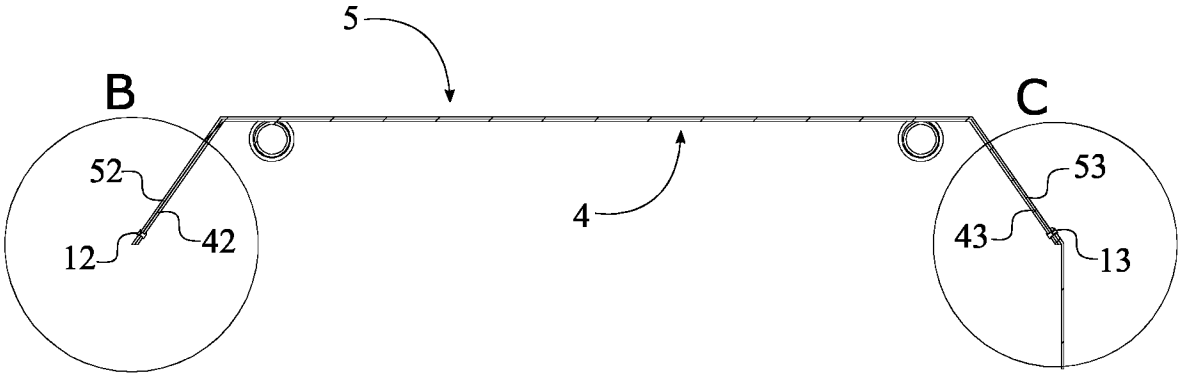
FIG. 7 is a cross section view of the present invention taken along line A-A of FIG. 6 and showing the sections that detailed views are taken shown in FIG. 8 and FIG. 9.
Figure 8:
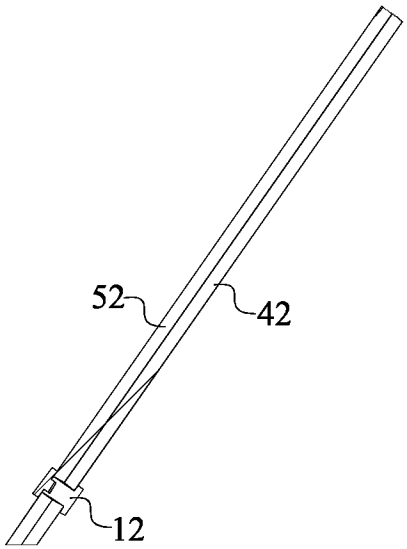
FIG. 8 is a detailed view of the present invention taken within the section B of FIG. 7.

The present invention further comprises a plurality of first inner openings 8 and a plurality of second inner openings 9 as shown in FIG. 4-5. The plurality of first inner openings 8 and the plurality of second inner openings 9 allow the first dome panel 4 and the second dome panel 5 to be mounted to each with respect to the first inner section 42 and the second inner section 52. Once the present invention is installed within the bathroom shower, the first inner section 42 and the second inner section 52 are positioned adjacent to a back wall of the bathroom shower that is positioned in between the two opposing walls.

In reference to FIG. 4-5, the plurality of first inner openings 8 traverses along the first inner section 42 and equally distributed along a distal edge 6 of the first inner section 42. The plurality of second inner openings 9 traverses along the second inner section 52 and equally distributed along a distal edge 6 of the second inner section 52. In reference to the first inner section 42 and the second inner section 52, at least one corresponding first inner opening from the plurality of first inner openings 8 is concentrically aligned with at least one corresponding second inner opening from the plurality of second inner openings 9 when the first dome panel 4 and the second dome panel 5 are positioned offset from each other. The at least one inner fastener 12 traverses through the corresponding first inner opening and the corresponding second inner opening in such a way that the least one inner fastener 12 adjacently mounts the first inner section 42 to the second inner section 52. For example, if five openings from the plurality of first inner openings 8 concentrically aligned with five openings from the plurality of second inner openings 9, the present invention utilizes five inner fasteners 12 to mount the first inner section 42 to the second inner section 52.

The present invention further comprises a plurality of first outer openings 10 and a plurality of second outer openings 11 as shown in FIG. 4-5. The plurality of first outer openings 10 and the plurality of second outer openings 11 allow the first dome panel 4 and the second dome panel 5 to be mounted to each with respect to the first outer section 43 and the second outer section 53. Once the present invention is installed within the bathroom shower, the first outer section 43 and the second outer section 53 are positioned adjacent to a bathroom shower opening, a shower curtain, or a bathroom shower door that is generally positioned opposite of the back wall.

In reference to FIG. 4-5, the plurality of first outer openings 10 traverses along the first outer section 43 and equally distributed along a distal edge 6 of the first outer section 43. The plurality of second outer openings 11 traverses along the second outer section 53 and equally distributed along a distal edge 6 of the second outer section 53. In reference to the first outer section 43 and the second outer section 53, at least one corresponding first outer opening from the plurality of first outer openings 10 is concentrically aligned with at least one corresponding second outer opening from the plurality of second outer openings 11 when the first dome panel 4 and the second dome panel 5 are positioned offset from each other. The at least one outer fastener 12 traverses through the corresponding first outer opening and the corresponding second outer opening in such a way that the least one outer fastener 12 adjacently mounts the first outer section 43 to the second outer section 53. For example, if three openings from the plurality of first outer openings 10 concentrically aligned with three openings from the plurality of second outer openings 11, the present invention utilizes three outer fasteners 12 to mount the first outer section 43 to the second outer section 53.

The plurality of telescopic rods 1 functions similar to existing telescopic shower curtain rods so that the plurality of telescopic rods 1 can be secured within the two opposing walls. In reference to FIG. 1-2, the plurality of telescopic rods 1 comprises an inner rod 2 and an outer rod 3. The inner rod 2 and the outer rod 3 are preferably secured to the two opposing walls by a tension mount mechanism. However, the inner rod 2 and the outer rod 3 can be secured with any other type of fastening mechanism that can withstand the weight of the first dome panel 4 and the second dome panel 5. In reference to FIG. 3, the first flat section 41 and the second flat section 51 are positioned atop the inner rod 2 and the outer rod 3. Since the inner rod 2 and the outer rod 3 are spaced apart from each other, the first dome panel 4 and the second dome panel 5 can be balanced and positioned atop the inner rod 2 and the outer rod 3. More specifically, the outer rod 3 is positioned adjacent to the first outer section 43 and the second outer section 53 as the first flat section 41 and the second flat section 51 are positioned atop the outer rod 3. Oppositely, the inner rod 2 is positioned adjacent to the first inner section 42 and the second inner section 52 as the first flat section 41 and the second flat section 51 positioned atop the inner rod 2. In reference to general configuration, the inner rod 2 and the outer rod 3 each comprises a first slidable poll, a second slidable poll, a first end bracket, a second end bracket, and a mounting mechanism. More specifically, the first slidable poll and the second slidable poll are telescopically engaged with each other. The first end bracket is terminally connected or engaged to the first slidable poll and positioned opposite of the second slidable poll. The second end bracket is terminally connected or engaged to the second slidable poll and positioned opposite of the first slidable poll. Depending upon different embodiments, the mounting mechanism can be either integrated into the first slidable poll and the second slidable poll or the first end bracket and the second end bracket.

Figure 9:
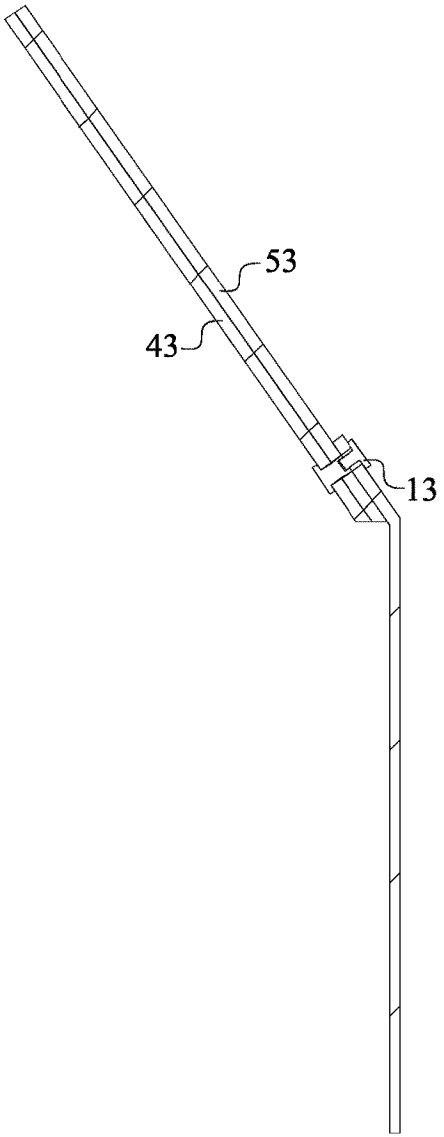
FIG. 9 is a detailed view of the present invention taken within the section C of FIG. 7.
Figure 11:
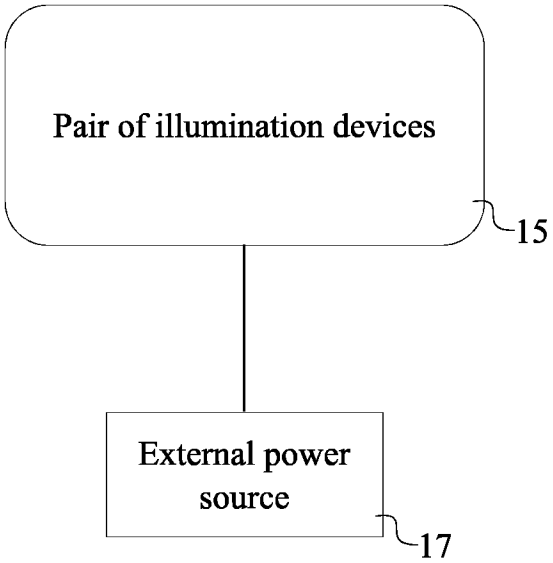
FIG. 11 is an electrical schematic showing the electrical connection of the pair of illumination devices and the external power source.
Figure 10:
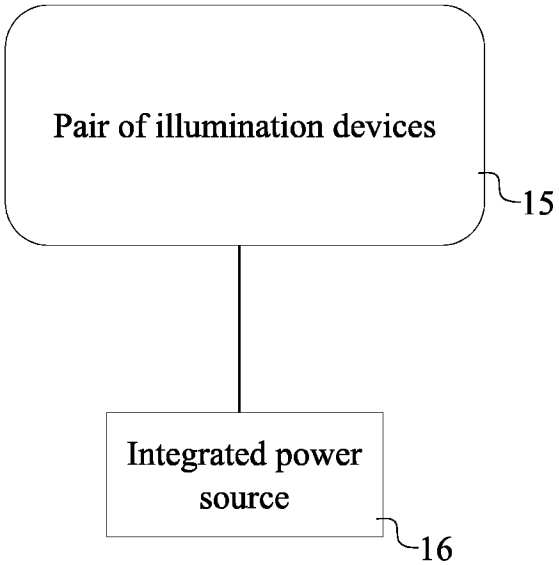
FIG. 10 is an electrical schematic showing the electrical connection of the pair of illumination devices and the integrated power source.

Depending upon the height of the shower head and the height of the bathroom shower door, the present invention may optionally require an extension panel 14 as shown in FIG. 1 and FIG. 9. For example, when the first dome panel 4 and the second dome panel 5 are installed within the two opposing walls and a gap is present in between the bathroom shower door and the distal edge 6 for the first outer section 43 and the distal edge 6 for the second outer section 53, the extension panel 14 is required to trap the steam vapor within the present invention. More specifically, the extension panel 14 is terminally positioned along the first outer section 43 and the second outer section 53 so that the extension panel 14 can be externally attached along the first outer section 43 and the second outer section 53. The extension panel 14 is preferably attached to the first outer section 43 and the second outer section 53 through the at least one outer fastener 12; however, the present invention can utilize any other type of easily detachable fasteners to attach the extension panel 14. The extension panel 14 is angularly oriented to the first outer section 43 and the second outer section 53 and vertically oriented downward toward the bathroom shower door thus covering the gap.

In reference to FIG. 1, the present invention may further comprise a pair of illumination devices 15 to provide additional lighting features for the bathroom shower. More specifically, the pair of illumination devices 15 is preferably attached to the first flat section 41 and the second flat section 51 thus providing lighting features through the present invention as the second dome panel 5 slides over the first dome panel 4. Furthermore, the pair of illumination devices 15 is spaced apart from each other in such a way to maximize the sliding distance of the first dome panel 4 and the second dome panel 5. The pair of illumination devices 15 can be configured with many different lighting features such as different color spectrums, different lighting effects, motion sensor activation, and any other types of user integrating features. The pair of illumination devices 15 can be either powered through an integrated power source 16 such as a battery or an external power source 17 such as an electrical outlet to facilitate wide range of power source options.

Optionally, the present invention can comprise a steam outlet and a slidable door so that the user is able to easily control the amount of steam vapor. More specifically, the steam outlet either traverses through the first flat section 41 or the second flat section 51. The slidable door is slidably and linearly mounted adjacent to the steam outlet so that the steam outlet can be partially opened, fully opened, or fully closed from the inside of the bathroom shower. By adjusting the slidable door, the user can easily control the amount of steam that can be trapped within the present invention throughout the showering process.

Although the invention has been explained in relation to its preferred embodiment, it is to be understood that many other possible modifications and variations can be made without departing from the spirit and scope of the invention as hereinafter claimed.

What is claimed is:

1. A shower attachment to keep steam within a bathroom shower comprises:
- a plurality of telescopic rods;
- a first dome panel;
- a second dome panel;
- at least one inner fastener;
- at least one outer fastener;
- the plurality of telescopic rods being mounted opposite of each other;
- the first dome panel and the second dome panel being slidably positioned offset of each other;
- the first dome panel and the second dome panel being terminally mounted to each other by the at least one inner fastener and the at least one outer fastener; and
- the first dome panel and the second dome panel being positioned atop the plurality of telescopic rods.

2. The shower attachment to keep steam within the bathroom shower as claimed in claim 1 comprises:
- the first dome panel comprises a first flat section, a first inner section, and a first outer section;
- the first inner section and the first outer section being oppositely positioned of each other about the first flat section;
- the first inner section being angularly connected along the first flat section;
- the first outer section being angularly connected along the first flat section, opposite of the first inner section; and
- the first inner section and the first outer section being oriented towards the plurality of telescopic rods.

3. The shower attachment to keep steam within the bathroom shower as claimed in claim 1 comprises:
- the second dome panel comprises a second flat section, a second inner section, and a second outer section;
- the second inner section and the second outer section being oppositely positioned of each other about the second flat section;
- the second inner section being angularly connected along the second flat section;
- the second outer section being angularly connected along the second flat section, opposite of the second inner section; and
- the second inner section and the second outer section being oriented towards the plurality of telescopic rods.

4. The shower attachment to keep steam within the bathroom shower as claimed in claim 1 comprises:
- a plurality of first inner openings;
- a plurality of second inner openings;
- the plurality of first inner openings traversing along a first inner section of the first dome panel;
- the plurality of first inner openings being equally distributed along a distal edge of the first inner section;
- the plurality of second inner openings traversing along a second inner section of the second dome panel; and
- the plurality of second inner openings being equally distributed along a distal edge of the second inner section.

5. The shower attachment to keep steam within the bathroom shower as claimed in claim 4 comprises:
- at least one corresponding first inner opening from the plurality of first inner openings being concentrically aligned with at least one corresponding second inner opening from the plurality of second inner openings;
- the at least one inner fastener traversing through the corresponding first inner opening and the corresponding second inner opening; and
- the first inner section and the second inner section being mounted to each other by the at least one inner fastener.

6. The shower attachment to keep steam within the bathroom shower as claimed in claim 1 comprises:
- a plurality of first outer openings;
- a plurality of second outer openings;
- the plurality of first outer openings traversing along a first outer section of the first dome panel;
- the plurality of first outer openings being equally distributed along a distal edge of the first outer section;
- the plurality of second outer openings traversing along a second outer section of the second dome panel; and
- the plurality of second outer openings being equally distributed along a distal edge of the second outer section.

7. The shower attachment to keep steam within the bathroom shower as claimed in claim 6 comprises:

at least one corresponding first outer opening from the plurality of first outer openings being concentrically aligned with at least one corresponding second outer opening from the plurality of second outer openings;

the at least one outer fastener traversing through the corresponding first outer opening and the corresponding second outer opening; and the first outer section and the second outer section being mounted to each other by the at least one outer fastener.

8. The shower attachment to keep steam within the bathroom shower as claimed in claim 1 comprises:

the plurality of telescopic rods comprises an inner rod and an outer rod;

a first flat section of the first dome panel and a second flat section of the second dome panel being positioned atop the inner rod and the outer rod;

the outer rod being positioned adjacent to a first outer section of the first dome panel and a second outer section of the second dome panel; and the inner rod being positioned adjacent to a first inner section of the first dome panel and a second inner section of the second dome panel.

9. The shower attachment to keep steam within the bathroom shower as claimed in claim 1 comprises:

an extension panel;

the extension panel being terminally positioned along a first outer section of the first dome panel and a second outer section of the second dome panel;

the extension panel being externally attached along the first outer section and the second outer section; and the extension panel being oriented parallel to the first outer section and the second outer section.

10. The shower attachment to keep steam within the bathroom shower as claimed in claim 1 comprises:

a pair of illumination devices; and the pair of illumination devices being attached to a first flat section of the first dome panel and a second flat section the second dome panel.

11. The shower attachment to keep steam within the bathroom shower as claimed in claim 10, wherein the pair of illumination devices is electrically powered through an integrated power source.

12. The shower attachment to keep steam within the bathroom shower as claimed in claim 10, wherein the pair of illumination device is electrically powered through an external power source.

* * * * *